United States Patent [19]

Nicholson

[11] 4,337,709

[45] Jul. 6, 1982

[54] WALL STORABLE TABLE ATTACHMENT TOP

[76] Inventor: James A. Nicholson, 10600 Van Stralen Way, Rancho Cordova, Calif. 95670

[21] Appl. No.: 871,102

[22] Filed: Jan. 20, 1978

[51] Int. Cl.[3] ..... A47B 33/00

[52] U.S. Cl. ..... 108/33; 108/42; 248/206 A

[58] Field of Search ..... 108/42, 90, 38, 48, 108/154, 157, 33; 248/206 A; 52/36

[56] References Cited

U.S. PATENT DOCUMENTS

| | | | |
|---|---|---|---|
| 1,923,281 | 8/1933 | Smith | 108/33 |
| 2,650,146 | 8/1953 | Mugler | 108/38 |
| 3,020,562 | 2/1962 | Reynolds | 248/206 X |
| 3,124,501 | 3/1964 | Wise | 248/206 A X |
| 3,379,144 | 4/1968 | Ellis | 108/33 |
| 3,930,701 | 1/1976 | Otakie | 108/90 X |

FOREIGN PATENT DOCUMENTS

| | | | |
|---|---|---|---|
| 1263521 | 5/1961 | France | 108/38 |

*Primary Examiner*—Roy D. Frazier
*Assistant Examiner*—Peter A. Aschenbrenner

[57] ABSTRACT

A storable table attachment top comprising a generally rectangular planar top member preferably of decorative wall paneling material as its surface, with said top member attached by its base to the upper surface of a generally rectangular base frame with said top member extending beyond said base frame on three and a fourth side flush with a side of said base frame thereat, a recessed projection provided laterally at the said base frame adjacent to said fourth side to provide a finger grip with said projection forming a back wall to the base of said frame to its end with said end a part of said back wall thereat providing primary support for said attachable table top in its stored position. Anchoring means for said base frame wherein said anchorage consists of two open ended elongated C-shaped channeled anchor bars with each having a flat top with downwardly extended sides which form opposing right angles to each other and spaced apart at the center to form a C-shaped channel there through the length of said anchor bar with said channel being open on both ends in the aforesaid C-shape, each said anchor bar is attached to the transverse side of said base frame at the flat top of said anchorage and laterally of said base frame with the opposed sides of said anchorage facing downward with said anchor bars spaced apart. A set of four clamping devices to secure said anchorage each in the form of J-shaped clamps having a flat rectangular top strip in the length of the aforesaid open channel with said top strip having a vertical elongated and downwardly extending strip attached to bottom side of said top strip with said extending strip in the size to extend downwardly between the open opposed sides of said anchor bar thereat extending outward to form a right angle with said angle forming an extended tab having a threaded aperture and a threaded shaft there through said aperture with said shaft having at its top a flat headed swivel and at the opposite end of said shaft a horizontally handle thereat the means for clamping the attachable table top to a common kitchen table. A wall mountable housing structure for the storage of said table attachable top with said structure having a pair of vertical side walls spaced apart substantially the same width as the fourth side of said base frame and a pair of horizontal end walls spaced apart substantially the length adjacent to said fourth side of said base frame, a planar back wall in attachment with said housing structure and a plurality of spacers, magnets and magnetically attracting plates strategically attached to said base frame and within said housing structure to hold said table attachable top received into said structure with all of the foregoing preferable in attachment with a paneled wall scheme.

3 Claims, 10 Drawing Figures

WALL STORABLE TABLE ATTACHMENT TOP

REFERENCES OF INVENTION

It appears that the arts have not provided a rather simple and inexpensive means of extending the working surface of the common kitchen table without adding extensive, expensive and complicated legging or supports therein providing a separate table in itself. The prior arts show a number of storable complete tables and particularly, a T.V. attachable surface extender which does not appear to be practicle for a handle equiped portable which is purchased for the very reason of portability. Other applications, U.S. Pat. No. 3,020,562 to John A. Reynolds shows the use of magnetic holding in a bath environment; U.S. Pat. No. 3,124,501 to Glenn E. Wise discloses the use of magnets to be attached to an appliance surface made of metal; U.S. Pat. No. 3,930,701 to Daniel A. Otakie discloses a T.V. surface extender; U.S. Pat. No. 3,379,144 to Robert Ellis, U.S. Pat. No. 1,923,281 to Benjamin Smith, U.S. Pat. No. 2,650,146 to Charles M. Mugler and French, Pat. No. 1,263,521 to Marcel Reeber all of which, disclose storable and holding means for a table to include, extensive support hardware thereby making the discloser a self supporting table and a complete table in itself.

SUMMARY OF THE INVENTION

There are many objects of the storable table attachment top but primarily it extends the common kitchen table and the like into a much greater working surface and after the initial installation and adjustment tools are no longer required. Being a storable object of this invention there is no need to purchase expensive dinning room furniture to accommodate company or the large family also, where there is a large family space is not sacrificed since in a wall paneling scheme the attachable top is stored within the decor of the room thereat blending in with the scheme of the room. Since many small families convert what would normally be a dinning room into recreation rooms this attachment top will provide a large game surface as well as buffet service space. Where space is premium as with small senior citizen apartments, motels or hotels and clubs the invention would be most beneficial for providing added table surface for socializing and business. Other objects will be readily apparent in the illustration of the drawings. As a cursory summary of the invention, a basically rectangular top member preferrable of room paneling material which is attached at its base to the of a solid yet lightweight base frame similar in size with said top extending beyond said frame and the fourth side flush with the base frame thereat, a laterally cored box having a back wall extension downwardly and recessed to its end to provide a finger grip for placement/removal from said tops stored mode, a pair of C-shaped open ended channeling anchoring bars which are attached to the transverse side of said base frame by the flat top of said anchor bars laterally of said base frame with the open channeling facing outward to receive the head of J-shaped clamps having vertically threaded means for attachment to the base of the edge of a common kitchen table and the like, a plurality of magnets and spacers attached to the transverse side of said frame to over-ride said anchor bars when top member is in its stored position within a wall attachable housing structure in combination with a wall paneling scheme.

VIEWS OF THE INVENTION

FIG. 9 is the operable mode atop a common kitchen table and the like.

DETAILED DESCRIPTION OF THE INVENTION

Figure 1:
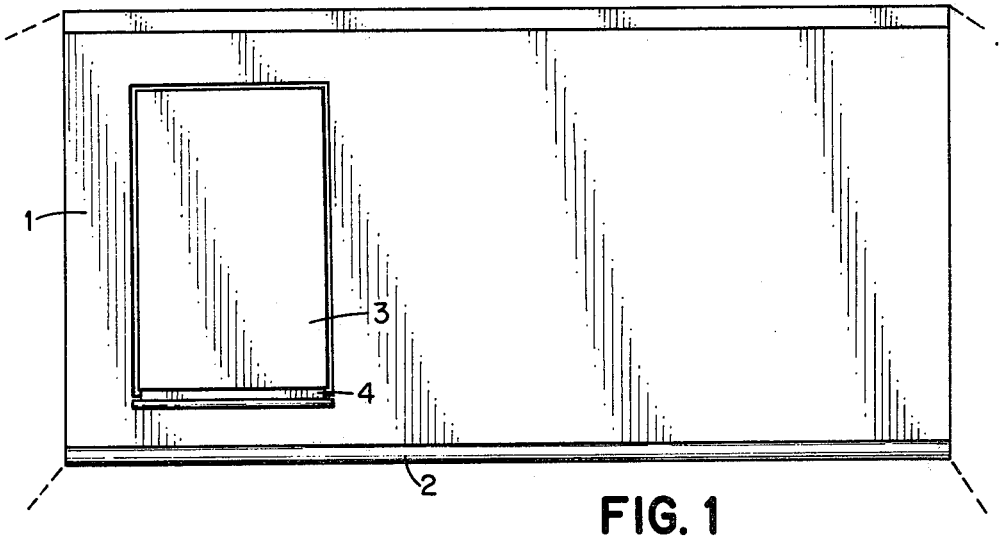
FIG. 1 is a front view of the storable table attachment top in a wall paneled scheme.
Figure 2:
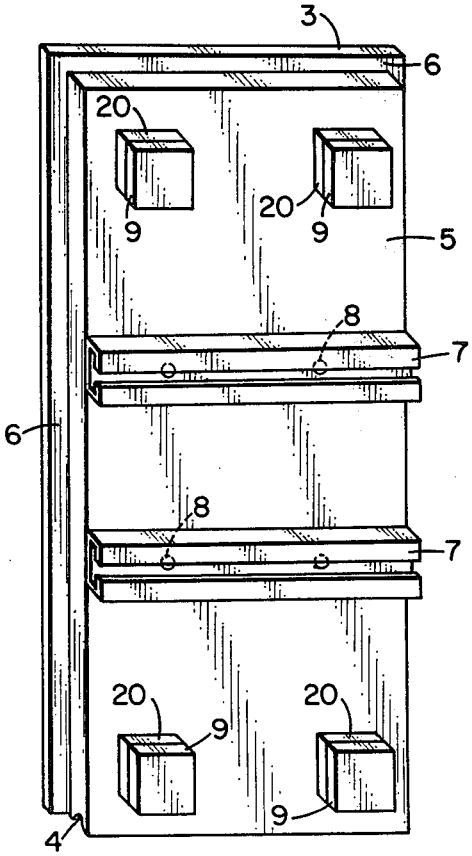
FIG. 2 is the transverse side of said attachable top and base frame to include magnets, spacers and phantoming of anchor bars.
Figure 3:
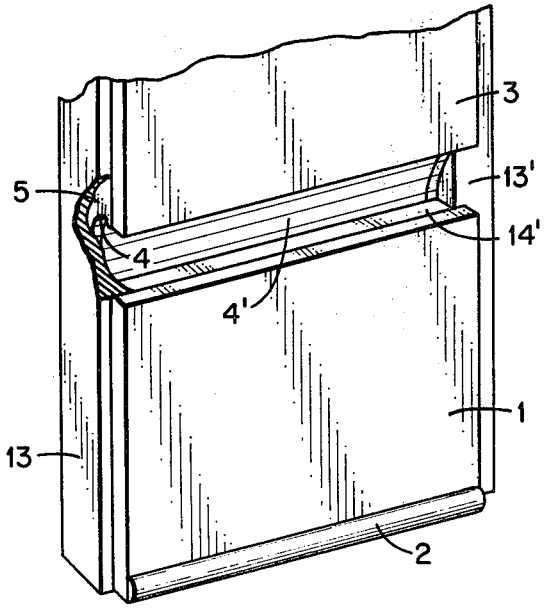
FIG. 3 is a fragmented front view of said top depicting hand grip opening.
Figure 4:
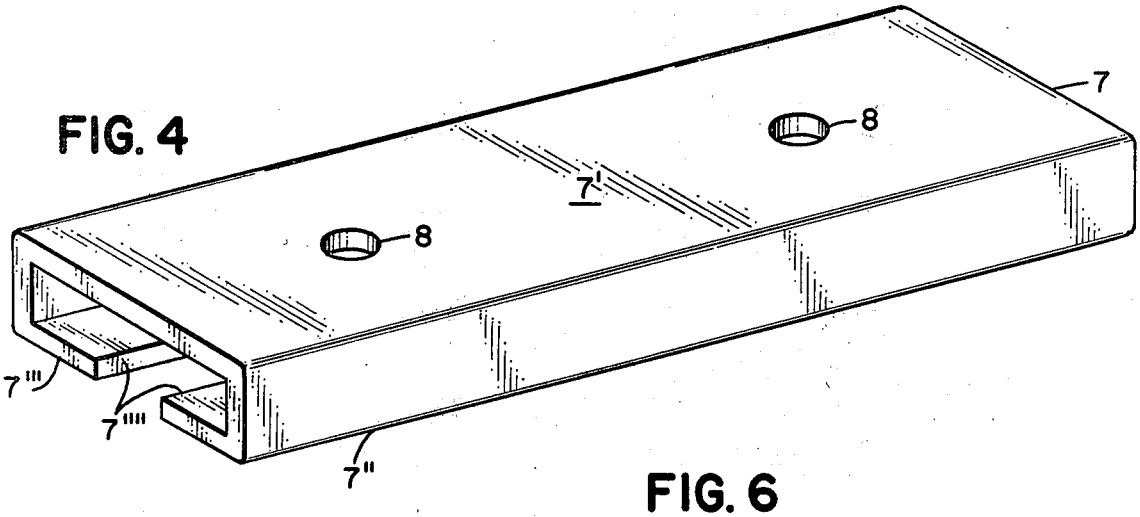
FIG. 4 is a angled view of one C-channeled anchor bar.
Figure 5:
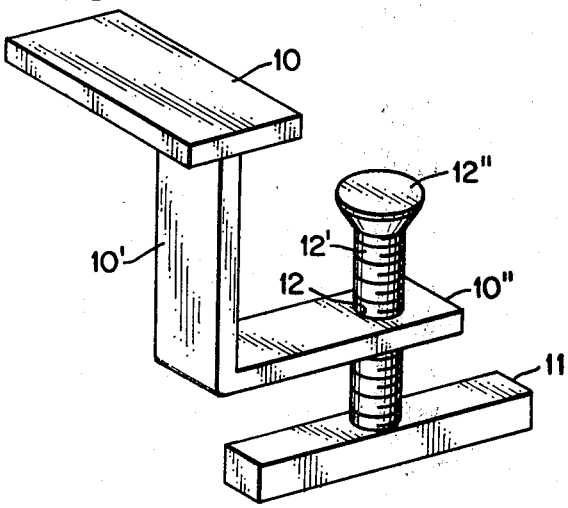
FIG. 5 is a side view of one of a plurality of J-shaped clamps.
Figure 6:
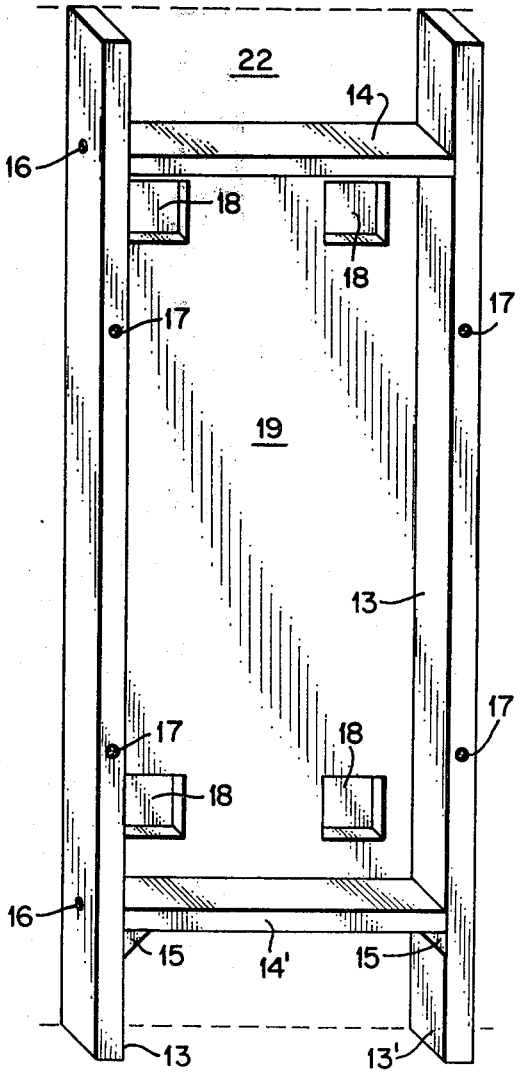
FIG. 6 is a front view of the wall attachable housing structure.
Figure 7:
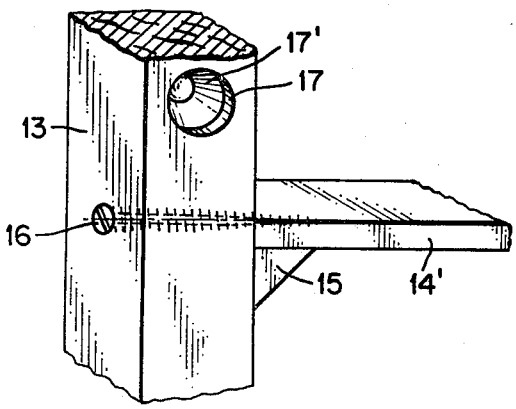
FIG. 7 is an exploded view recessed securing means and added support means.
Figure 8:
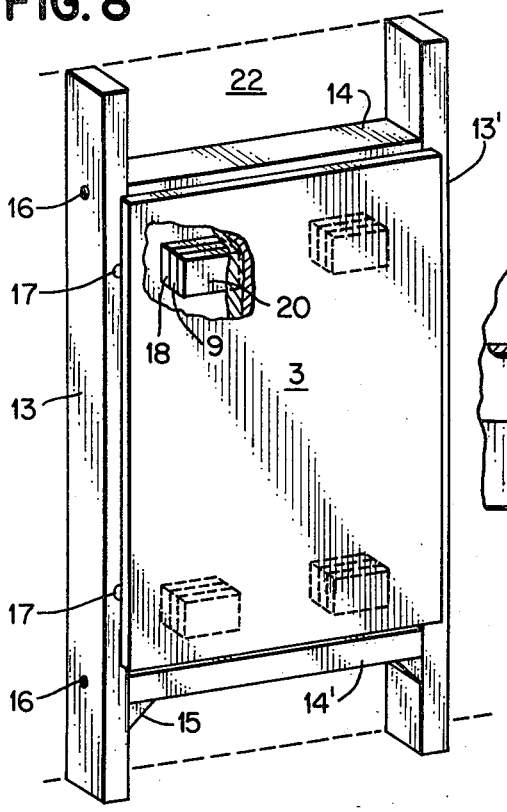
FIG. 8 is the stored mode of said top within housing structure.
Figure 10:
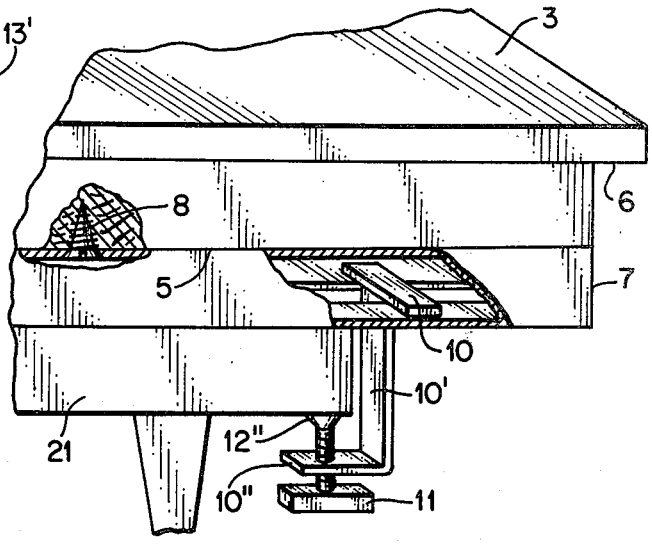
FIG. 10 is the lateral securing mode of anchor bars and J-shaped clamps.
Figure 9:
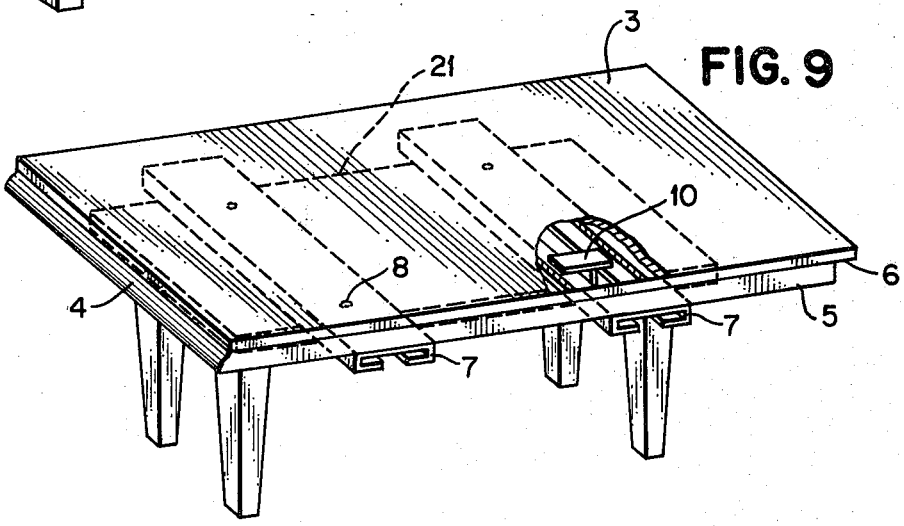

The storable table attachable top in its preferred construction is from wall paneling material with its outward decor, the solid or one piece base frame can be fabricated from wood, compositions of wood and/or plastic alloys using the molding principles also, synthetic firm rubber can be used. The C-shaped open channeled anchor bars can be made using the same principles and materials also, the J-shaped clamps may be made with the same methods using the same materials in a much hardened form however, it is preferred that light metals be used for fabrication of the anchor bars and clamps. It is also preferred that permanent magnets be used in association with the invention. As a totally applied and stored embodiment of the table attachment top 3 in a paneled wall scheme 1 and with the lateral finger grip opening 4 at the base of said attachment top to include associated base boards 2 it can be readily visualized (FIG. 1) that the aforesaid top member blends in and maintains the continuity and beauty of a paneled wall scheme. Further, the wall as depicted in the above figure need not be a full or large wall for the table attachment top in a paneled scheme, it can be placed on a much smaller wall like a corner niche type wall adjacent to a door way to a kitchen or the like. It is preferred that the top 3 of said table attachment be made from wall paneling material with the decrative side being the working surface of said top member wherein said member is basically rectangular in shape and attached at its none working surface to the top of a smaller yet rectangular shaped solid, lightweight, base frame 5 thereat in attachment the top 3 overhangs the base frame on three sides 6 with fourth side 6' flush with the end of said base frame. In that overhanging manner the provision is made for partial over-lapping of the facings of the storage housing structure thereby maintaining the continuity and beauty of a paneled wall scheme. So that the attachable table top may be placed into and easily removed from its storage position a finger grip opening 4 is provided laterally and inwardly of and at the base frame which is flush with the fourth side 6′ of said table top 3 an opening 4 in the base frame is made by core boxing principles in an upwardly and downwardly curved manner to provide a recessed downwardly extended back wall 4′ laterally of said frame and to the end of same thereat the aforesaid finger grip is provided for the afore reasons and as illustrated in the drawings (FIG. 3). As is illustrated in the same figure the rearward or recessed wall 4′ is designed and is used to support the attachable top's full weight on a cross member 14′ of the wall attachable housing structure (FIG. 6). So that the table attachable top can be attached to a common kitchen table and the like two elongated open ended C-shaped and inwardly channeled anchor bars 7 are provided and it is preferred that they be unattached at purchase thereby the consumer can make the initial adjustments in balance and stabilization to their particular kitchen table and the like. Each of the said C-channeled anchor bar 7 is attached to the transverse side 5′ of the solid base frame 5 laterally of said frame with the flat top 7′ of said anchor bar facing the transverse side 5′ of said frame thereat the open 7′′′′ opposed channeled sides 7′′′ are facing downward and thereby secured with a common wood type screw (FIG. 10) through the inline and spaced apart apertures 8 provided in the flat top 7′ of said anchor bar. With each anchor bar secured laterally each open end 7′′′′ of said anchor bar is in position to receive the top of a basically J-shaped clamp. With the anchor bars attached the height of said bars must be equalized for the attachment top to be stored in its housing structure therefore, basically square and/or rectangular shaped spacers 20 in combination with magnets 9 are used to slightly override said anchor bars with said magnets similar in size to the spacers used. Each of the plurality of spacers and magnets are coated on one with self adherent adhesive thereat the spacers 20 are attached to the transverse side 5′ of the said base frame adjacent each to a corner of said frame and each spacer is topped with the coated side of a magnet. In that stacking combination the magnet will be slightly forward of the anchor bars 7 thereby facilitating attachment to a plurality magnetically attracting plates positioned the housing structure (FIG. 6). Should magnetically attracting metal be used for the fabrication of the anchor bars said bars 7 would become attracting plates and the magnets location may be within the confines of the housing structure thereby the spacers 20 could be eliminated. Referring back to the J-shaped clamps, each of the plurality of clamps has a rectangular shaped top strip 10 in the horizontal position which is in the same position as the open C-shaped channel 7′′′′ of said anchor bars. In that position the basic holding and securing relationship is established between the open C-shaped anchor bars and the J-shaped clamps. The top 10 of the clamp is attached to a downwardly extending strip 10′ to form a right angle with said angle extension forming a tab 10″ thereby the reference J-shaped, and centrally of said tab a circular threaded aperture 12 through which a circular threaded and vertical shaft 12′ is provided wherein said shaft is sufficiently elongated to extend upwardly and downwardly beyond said threaded aperture 12 thereat providing ample extension for attachment to the underside of a common kitchen table edge and the like also, to reduce damage to said underside, a circular flat headed swivel 12″ is attached to the top end of said vertical shaft and at the opposite end of the same a horizontally positioned and attached a bar shaped handle 11 provides the means to operate the threaded vertical shaft. With the foregoing the clamp top is inserted and slid along the open channel of the anchor bar until J-shaped clamp abuts the underside of a kitchen table and the like thereat the swivel is engaged with the underside at the tables edge through the use of bar type handle and cinched securely. For each anchor bar in use two J-shaped clamps are required. Also, where a table attachable top is used in the size of a ping pong recreational table surface there may be a requirement for additional anchor bars and J-shaped clamps (FIGS. 4–5). As indicated earlier it is preferred that the invention be installed in conjunction with a wall paneling scheme thereby, the housing structure for storage of the said table attachable top (FIG. 1) would blend in with the decor of the room. The wall attachable housing structure is designed to be attached to a planar back wall within a room and said structure consist of a pair of elongated vertical slats rectangular in shape wherein said slats 13–13′ are spaced apart to form vertical side walls in approximately the same width as the aforementioned base frame 5 to provide close proximity thereat for it is to be recalled that the three sides 6 overlap the base frame therefore, they overlap and cover the outward face of the slats 13–13′ partially. Also, a pair of slat 14–14′ are opposingly spaced apart horizontally to form end walls which are approximately at the length of said base frame and in close proximity with said end walls thereat, the enclosure is provided for the attachable top (FIG. 8). The base end wall slat 14′ at its base and adjacent to both 13–13′ vertical walls is reinforced with a triangular shaped wedge 15–15′, this reinforcement is preferred since it is the wall base 14′ that will support the weight of the stored attachable top also, to insure continued maintenance of said support elongated screws 16 are secured through the vertical outer wall of each opposing wall 13–13′ and into the horizontal end walls 14–14′ (FIG. 6). To maintain a smooth outer surface of the vertical framework 13–13′ when it is attached to a back wall 22 in a room two circular apertures 17 are predrilled and counter sunk 17′ in the outer face of each vertical wall slat 13–13′ also, it is preferable that said apertures be within the periphery facing of the four walls of the housing enclosure for in that manner the inner rectangular shape of said enclosure will be strengthened also, for some materials that may be used, it will prevent warping of the frame work thereby a stable structure. With the above base wall 14′ supporting the weight of the storable table attachable top (FIGS. 1–3–8) stabilizers are used to maintain the vertical stored position of said top. In the form of square and/or rectangularly shaped magnetically attracting plates 18, similar in size to the magnets and spacers of the foregoing and in mating alignment with the same, each said plate is adhesively coated on one side thereat attached adjacent to the corners of the four walls of said enclosure and to the back planar wall 22 of the room. With all of the foregoing applied in a paneled wall scheme the invention will enhance the beauty of the room and provide additional table surface when the need arises. Realizing that when the attachable table top is removed an unsightly void may be evident to some it is preferred that a mirror 19 be installed within the periphery of the metal attracting plates 18 thereat reflection of other objects in the room will further enhance the beauty therein. The illustrations 8–10 are intended to show the operable modes of the foregoing specifications, i.e., the storable position within the housing structure, the operable position atop a common kitchen table and the like 21 and finally, the securing position widthwise of the anchoring means.

What I claim is:

1. A storable table attachable top comprising, a generally rectangular planar top member, said top member being attached by its base to the upper surface of a generally rectangular base frame with the edges of said top member extending beyond said base frame on three sides thereof, the fourth edge of said top member being flush with the top of a side of said base frame, said side of said base frame being provided with a lateral projection with a recess therein, said recess providing a curved downwardly extending back wall culminating at one end of the base frame to form a finger grip; means for providing an anchorage for clamping devices, said means being attached to the bottom of said base frame; magnetic holding means comprising a plurality of spacers, each said spacer being provided with a magnetically attractable plate on the outer surface and having an inner surface attached to the bottom of said base frame, each said spacer having a height sufficient to space the magnetically attractable plate further from the base frame than the height of said means of providing for the anchorage for clamping devices.

2. A storable attachable top as defined in claim 1, in which said means for providing an anchorage for the clamping devices comprise, a pair of open ended C-shaped channel anchor bars, each said bar having a flat top portion and two spaced apart side portions, said side portions extending downwardly and inwardly to form a downwardly opening slot into the channel of said bar, said bars being spaced from each other and attached transversely across the bottom of said base frame; a set of clamping devices, each said clamping device comprising a flat top strip attached transversely to a downwardly extending elongated strip having a tab extending at a right angle at the lower end thereof, said tab being threaded and receiving a threaded shaft having a flat head swivel attached at the upper end thereof and a handle at the lower end thereof, the length of said top strip being substantially the same as the width of the channel in said anchor bar and the width of said elongated strip being substantially the same as the width of the slot in said anchor bar, whereby the top strip of each clamping device is slidably receivable in the channel of one of said anchor bars with the elongated strip extending downwardly through the slot in the anchor bar so that the attachable top may be attached to the top of a smaller conventional table by said clamping devices to provide an enlarged top for a conventional table.

3. In combination with the table attachable top as defined in claim 2, a housing structure mountable to a room wall, said housing structure having a pair opposed vertical side walls spaced apart substantially the same distance as the width of the fourth side of said top member and a pair of horizontal opposed end walls spaced apart substantially the same distance as the length of one of the sides of said top member adjacent said fourth side; a vertical back wall connecting said side walls and end walls and a plurality of magnets attached to said back wall at locations corresponding to the locations of said spacers and plates on said base frame, whereby said table attachable top may be attached in said housing structure with the base frame thereof received in said housing structure and the upper surface of said top member partially covering portions of said housing structure face, said magnets and magnetically attractable plates holding said attachable top in place and said recess in the base frame providing means for gripping the attachable top for easy removal thereof from said housing structure.

* * * * *